US006123633A

United States Patent [19]

Guenther et al.

[11] Patent Number: 6,123,633

[45] Date of Patent: Sep. 26, 2000

[54] INFLATABLE GAME BALL WITH A LOBULAR CARCASS AND A RELATIVELY THIN COVER

[75] Inventors: Douglas G. Guenther, Carol Stream; Bradley Lee Gaff, Naperville, both of Ill.

[73] Assignee: Wilson Sporting Goods Co., Chicago, Ill.

[21] Appl. No.: 09/146,091

[22] Filed: Sep. 3, 1998

[51] Int. Cl.[7] ..... A63B 41/08

[52] U.S. Cl. ..... 473/604; 473/596

[58] Field of Search ..... 473/603, 604, 473/605, 609, 614, 596, 597

[56] References Cited

U.S. PATENT DOCUMENTS

| | | | |
|---|---|---|---|
| 1,240,866 | 9/1917 | Miller . | |
| 1,402,682 | 1/1922 | Takashima . | |
| 1,614,853 | 1/1927 | Schwartz . | |
| 2,061,604 | 11/1936 | Winterbauer . | |
| 2,214,179 | 9/1940 | Reach . | |
| 2,280,314 | 4/1942 | Scudder . | |
| 2,494,796 | 1/1950 | Brown . | |
| 2,494,806 | 1/1950 | Gibson . | |
| 2,653,818 | 9/1953 | Tebbetts, Jr. et al. . | |
| 2,761,684 | 9/1956 | Crowley . | |
| 2,789,821 | 4/1957 | Crowley . | |
| 2,819,753 | 1/1958 | Nogué . | |
| 2,896,949 | 7/1959 | Dunker . | |
| 3,119,618 | 1/1964 | Molitor et al. . | |
| 3,219,347 | 11/1965 | Way . | |
| 3,256,019 | 6/1966 | Barton . | |
| 3,506,265 | 4/1970 | Yugi . | |
| 3,508,750 | 4/1970 | Henderson | 473/605 |
| 3,863,923 | 2/1975 | Anderson . | |
| 3,948,518 | 4/1976 | Tebbetts, Jr. . | |
| 4,093,219 | 6/1978 | Piraud . | |
| 4,187,134 | 2/1980 | Svub et al. . | |
| 4,239,568 | 12/1980 | Takazawa . | |
| 4,333,648 | 6/1982 | Aoyama . | |
| 4,462,590 | 7/1984 | Mitchell . | |
| 4,660,831 | 4/1987 | Kralik . | |
| 5,040,795 | 8/1991 | Sonntag . | |
| 5,069,935 | 12/1991 | Walters . | |
| 5,310,178 | 5/1994 | Walker et al. . | |
| 5,320,345 | 6/1994 | Lai et al. . | |
| 5,413,331 | 5/1995 | Stillinger . | |
| 5,500,956 | 3/1996 | Schulkin et al. . | |
| 5,542,662 | 8/1996 | Kouzai et al. . | |
| 5,551,688 | 9/1996 | Miller . | |
| 5,636,835 | 6/1997 | Schindler et al. . | |
| 5,669,838 | 9/1997 | Kennedy et al. . | |
| 5,681,233 | 10/1997 | Guenther et al. . | |
| 5,752,890 | 5/1998 | Shishido et al. | 473/604 X |
| 5,931,752 | 8/1999 | Guenther et al. | 473/604 X |

FOREIGN PATENT DOCUMENTS

WO 96/35482 11/1996 WIPO .

*Primary Examiner*—Raleigh W. Chiu

[57] ABSTRACT

A game ball including a carcass and a plurality of thin cover panels which have a substantially uniform thickness. The carcass is shaped so that the outer surface of the ball has a plurality of lobes even though the cover has a uniform thickness. The carcass has an outer surface which includes a plurality of generally spherical portions, channels between adjacent spherical portions, and recessed surface portions between each channel and the adjacent spherical portions.

11 Claims, 4 Drawing Sheets

INFLATABLE GAME BALL WITH A LOBULAR CARCASS AND A RELATIVELY THIN COVER

BACKGROUND

This invention relates to game balls, and, more particularly, to an inflatable game ball with a carcass and a cover.

Game balls such as basketballs, soccer balls, and footballs conventionally include an inflatable bladder and a cover. The bladder may be reinforced with windings of nylon thread, polyester thread, etc. The cover is conventionally formed from panels of cover material, for example, leather, synthetic leather, or rubber. Adjacent panels are separated by rubber channels.

The portion of the ball excluding the cover is conventionally referred to as the carcass. Historically, basketballs have been made by first forming an inflatable rubber bladder, inflating the bladder, and molding the bladder under heat and pressure to vulcanize the rubber. After the bladder is removed from the mold, the bladder is wound with reinforcing thread which forms a layer of windings. The thread may be dipped in latex or adhesive. Pieces of rubber are then laid over the wound bladder, and the rubber-covered wound bladder is molded under heat and pressure to vulcanize or cure the pieces of rubber and to fuse the pieces of rubber to each other and to the layer of windings. The molded product is the carcass.

The surface of the carcass mold is provided with grooves which form upwardly extending projections on the surface of the carcass. The projections will form the seams or channels of the completed ball. The portions of the carcass between the channels are spherical. Panels of cover material are laid into the areas of the carcass between the channels, and adhesive may be applied to the cover panels and/or the carcass. The covered carcass is placed in a mold having the shape of the completed ball to form the ball under heat and pressure.

Leather covered basketballs have conventionally used relatively thick leather panels, for example, having a thickness of about 1.6 mm. The leather material was often originally designed for use in shoes and was therefore thicker than may have been necessary for a basketball cover.

Skilled workers who apply cover panels to basketballs have traditionally tapered or skived the edge portions of the cover panels which are adjacent the channels. The cover panels are therefore relatively thick over the portions of the ball between the channels and relatively thin and tapered adjacent the channels.

The varying thickness of each cover panel provides the basketball with a lobular outer surface which includes lobes between the channels. The portion of most of the outer surface between adjacent channels is generally spherical, but the portions of the outer surface adjacent the channels are depressed or recessed.

A lobular surface on a basketball is preferred by many players because it is easier to grip. As a result, many basketballs are made with a lobular surface even if the cover panels are not genuine leather. The lobular surface may be provided in the conventional manner by using relatively thick cover panels which are tapered or skived in the edge portions which are adjacent the channels.

The cost of the cover is a major factor of the cost of a basketball. That is particularly true for leather covers, but is also true for synthetic leather and other cover materials such as polyurethane and PVC. Decreasing the thickness of the cover would decrease the cost of the ball. However, a thinner cover could not be skived to provide the desired lobular surface.

SUMMARY OF THE INVENTION

The invention provides a game ball with a lobular outer surface but with a significantly thinner cover. The thinner cover substantially reduces the cost of the ball.

The lobular outer surface is provided by molding the carcass so that the portions of the outer surface of the carcass between the channels are lobular. The thin cover panels have a uniform or substantially uniform thickness and conform to the lobular surface of the carcass. The resulting ball has the same look and feel of a traditional lobular ball.

DESCRIPTION OF THE DRAWINGS

The invention will be explained in conjunction with an illustrative embodiment shown in the accompanying drawing, in which—

DESCRIPTION OF SPECIFIC EMBODIMENTS

Figure 1:
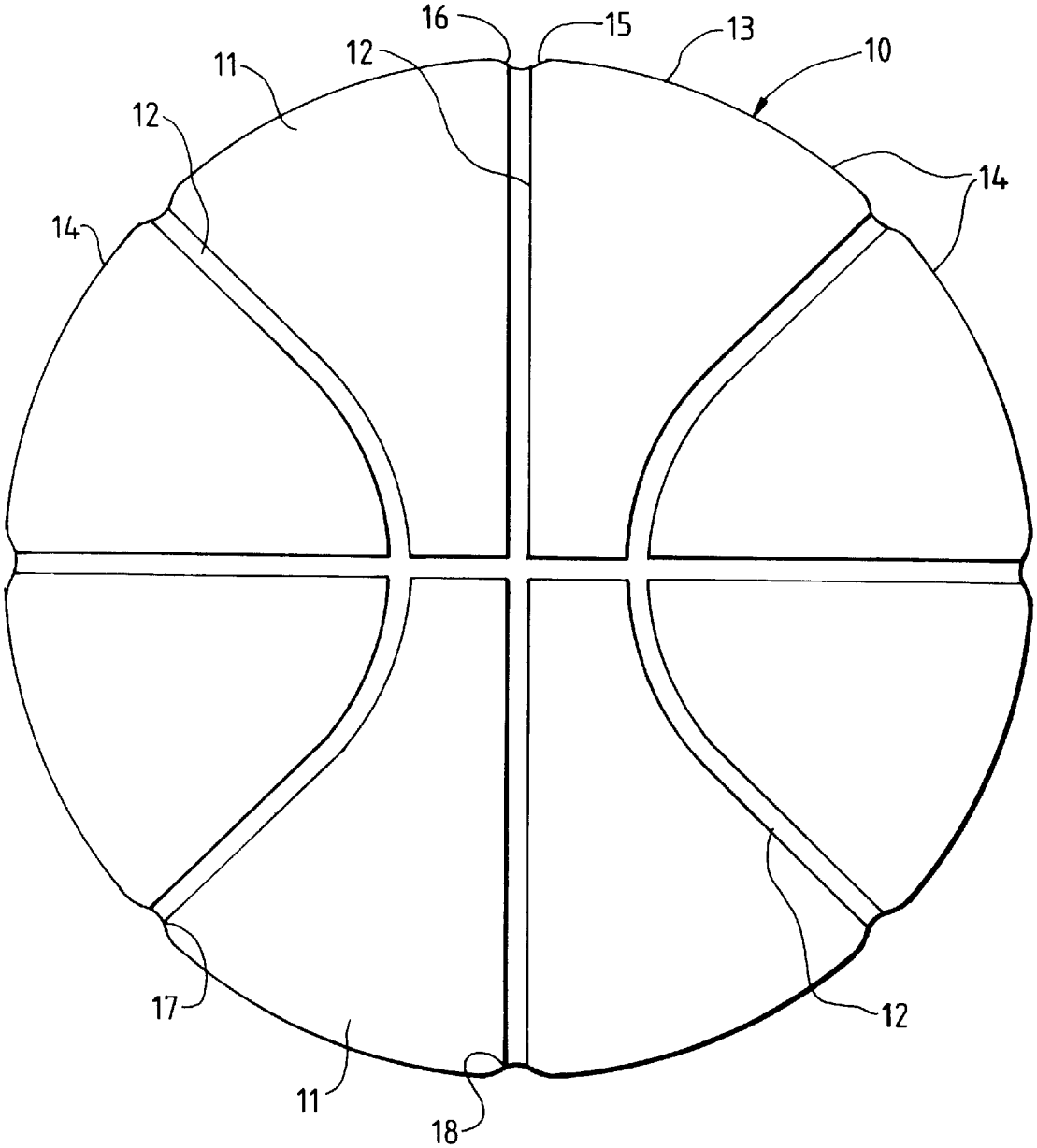
FIG. 1 PRIOR ART
FIG. 1 illustrates a conventional prior art basketball with a lobular outer surface.

The prior art basketball 10 of FIG. 1 includes a plurality of cover panels 11 which are separated by rubber channels 12. The ball has an outer surface 13 which includes generally spherical portions 14 between the channels and depressed or recessed portions 15 and 16 on the opposite sides of each channel. The recessed portions of the outer surface merge with the channels 12. The generally spherical portions 14, the recessed portions 15 and 16, and the channels 12 provide the ball with lobularly shaped portions between the channels. The spherical portions form the high points of the lobes, and the recessed portions form the sides or edges of the lobes.

As is well known in the art, the basketball 10 is conventionally made by applying the cover panels 11 to a molded rubber carcass. The edge portions 17 and 18 of the cover panels which are adjacent the channels are tapered or skived to provide the recessed portions 15 and 16 of the outer surface of the ball.

Figure 2:
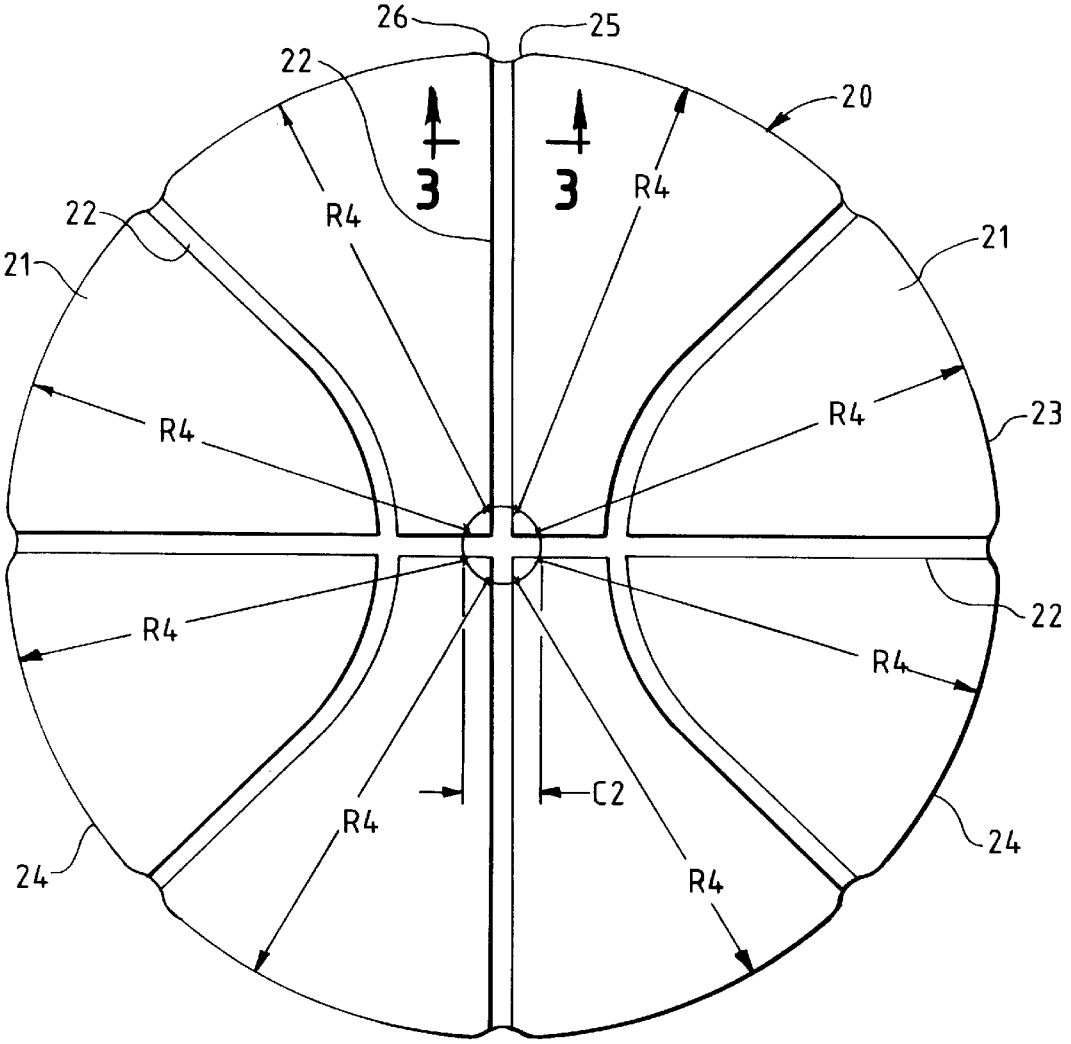
FIG. 2 illustrates a basketball which is made in accordance with the invention.

FIG. 2 illustrates a basketball 20 which is made in accordance with the invention. The basketball 20 also includes a plurality of cover panels 21 which are separated by rubber channels 22. The appearance of the ball 20 is substantially the same as the appearance the ball 10. The ball 20 has a lobular outer surface 23 which includes generally spherical portions 24 between the channels and recessed portions 25 and 26 on the opposite sides of each channel.

Figure 3:
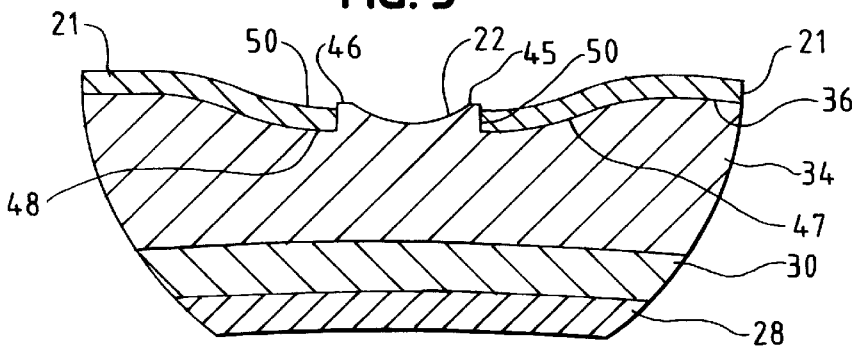
FIG. 3 is an enlarged fragmentary sectional view taken along the line 3—3 of FIG. 2.

The basketball 20 includes a conventional inflatable bladder 28 (FIG. 3). The bladder is preferably formed primarily of rubber. In the preferred embodiment the bladder was made from 80% butyl rubber and 20% natural rubber.

Figure 4:
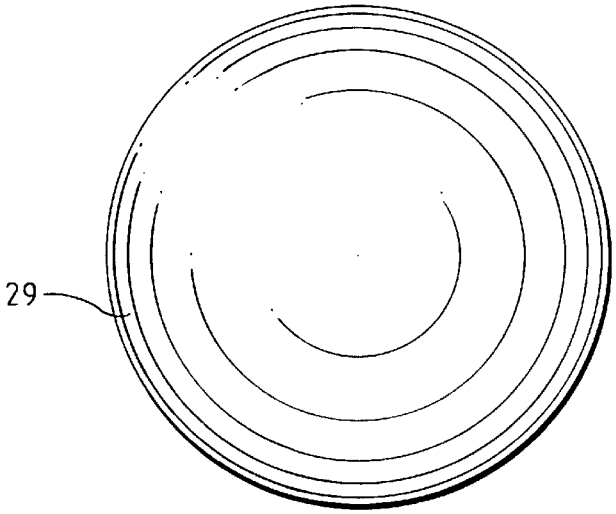
FIG. 4 illustrates the bladder which is used to form the ball of FIG. 2.

The bladder is inflated and placed in a vulcanizing or curing mold where the bladder is cured at 160° C. After curing, the inflated bladder is wound with reinforcing thread 29 (FIG. 4) which forms a layer of windings 30 (FIG. 3). In the preferred embodiment the layer of windings was formed from about 2100 meters of 210 denier Nylon 66 thread. The thread is preferably coated with latex or adhesive.

Figure 5:
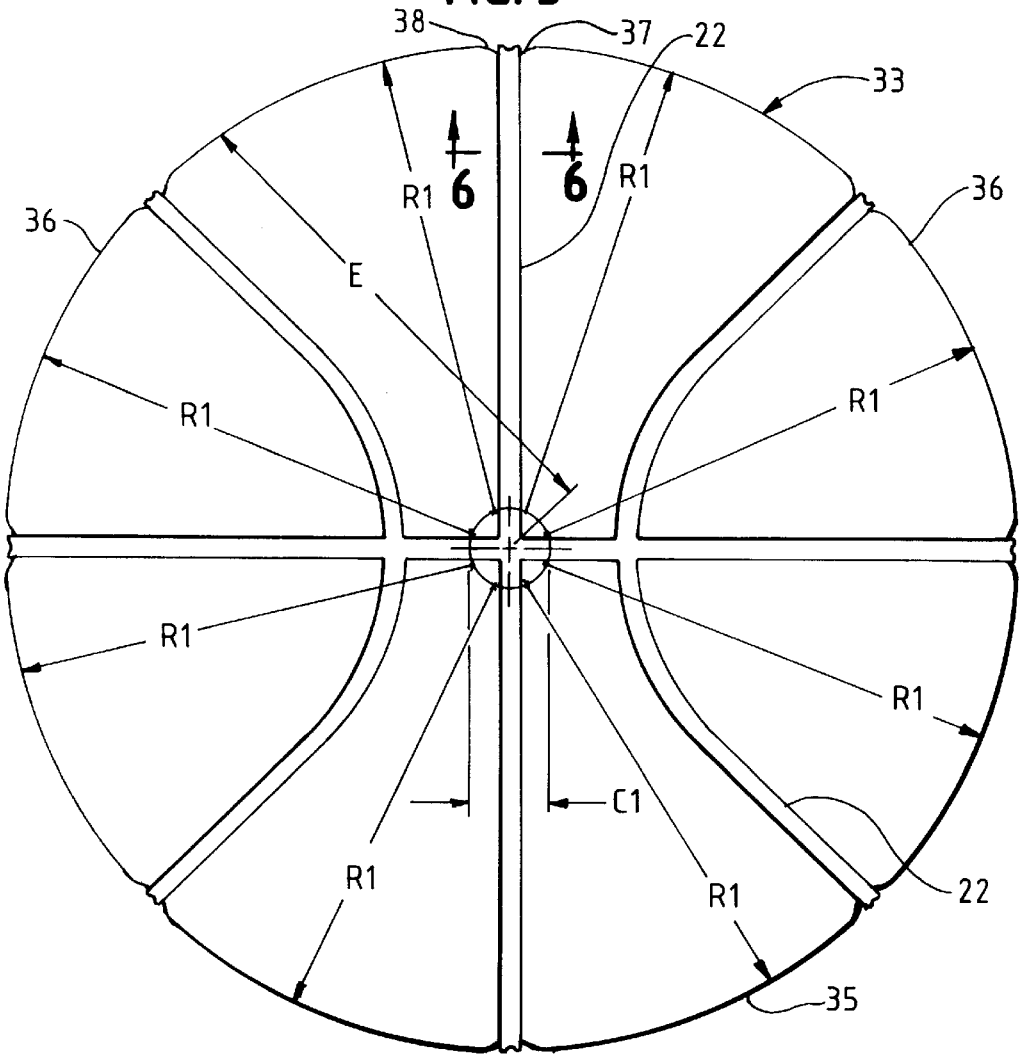
FIG. 5 illustrates the carcass which is used to form the ball of FIG. 2.
Figure 6:
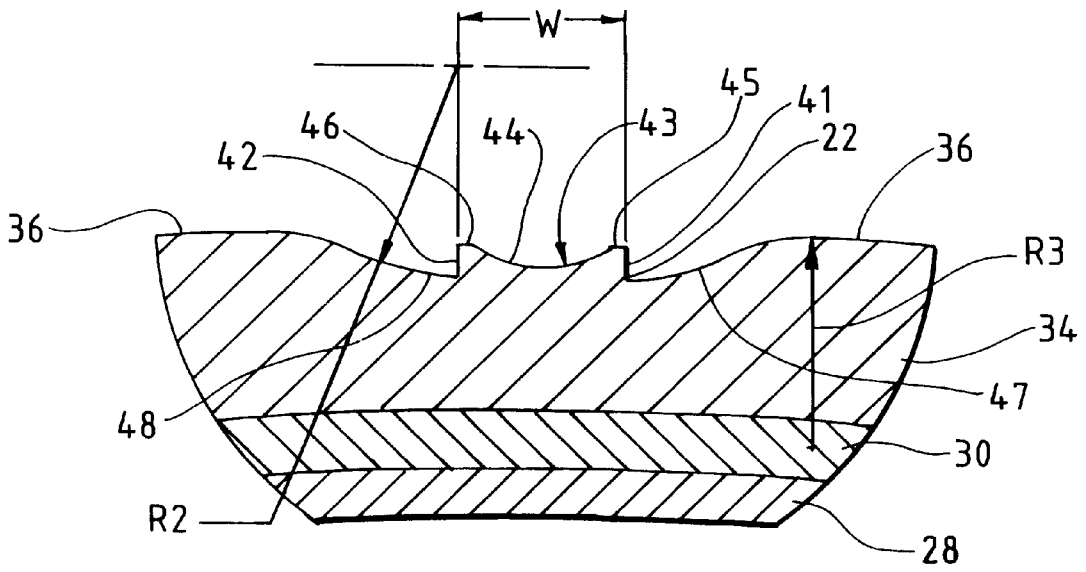
FIG. 6 is an enlarged fragmentary sectional view taken along the line 6—6 of FIG. 5.

Flat sheets or panels of rubber are laid over the wound bladder. The rubber panels can be natural and/or butyl rubber or can be sponge rubber as described in U.S. Pat. No. 5,681,233. The rubber completely covers the wound bladder. The inflated rubber-covered bladder is then placed in a spherical carcass mold where it is heat molded at about 160° C. to form the carcass 33 (FIG. 5). During the molding process, the rubber panels fuse to each other and to the windings 30 and form an integral outer rubber layer 34 on the carcass (FIG. 6).

The inside surface of the carcass mold is shaped to form the contours of the lobular outside surface 35 of the carcass. The outside surface of the carcass includes the channels 22, spherical portions 36, and recessed portions or troughs 37 and 38 along the sides of each of the channels. The spherical portions 36 and recessed portions 37 and 38 form lobes between each pair of channels.

Each of the spherical portions 36 has a radius $R_1$ which extends from the circumference of a circle $C_1$ at the center of the ball. In one specific embodiment the diameter at the high points of the lobes of the carcass was 9.252 inches, the radius $R_1$ was 4.260 inches, and the diameter of the circle $C_1$ was 0.732 inch. The dimension E from the center of the ball to the bottom of the recessed portions 37 and 38 was 4.539 inches.

In the particular embodiment illustrated, each of the spherical portions 36 is a portion of a sphere which has a constant radius. However, truly spherical portions are not required in order to provide the desired lobular shape for the outer surface. Generally spherical surface portions which curve or bulge outwardly from the recessed portions 37 and 38 will provide the lobular shape even if the surface portions do not have a constant radius.

FIG. 6 shows the area which surrounds each channel 22. Each channel extends generally radially outwardly from the center of the ball and includes flat parallel side walls 41 and 42 and an outer surface 43 which includes a concave central portion 44 and a pair of flat outer end portions 45 and 46.

The recessed portions 37 and 38 of the outer surface of the carcass are formed by generally S-shaped curved surfaces 47 and 48 which extend laterally outwardly and upwardly from the base or bottom of a channel to merge with the spherical surfaces 36. The cross sectional thickness of the carcass is greater through the spherical portions 36 than through the curved surface portions 47 and 48.

The channels project outwardly so that the cross sectional thickness of the carcass through the outer flat surfaces 45 and 46 is substantially the same as the cross sectional thickness through the spherical portions 36. In the specific embodiment illustrated, the cross section through the surfaces 45 and 46 is slightly less than the cross section through the spherical surfaces 36.

In one specific embodiment the width W of the channels was 0.197 inch, and the height of the side walls 41 and 42 was 0.039 inch (1 mm). The radius $R_2$ of the curved surfaces 47 and 48 adjacent the channels was 0.257 inch. The radius $R_3$ of the curved surfaces adjacent the spherical surfaces 36 was 0.250 inch.

If desired, the channels 22 can be formed separately from the rest of the carcass and attached to the carcass after the carcass is molded as described in co-owned and co-pending U.S. patent application entitled "Inflatable Game Ball with Laid-In Channel or Logo," Ser. No. 09/007,348, filed Jan. 15, 1998. If the carcass includes a layer of sponge rubber, the channels could be formed from the sponge rubber.

After the carcass is formed, panels of cover material 21 are laid over the carcass between the channels 22 as shown in FIG. 3. Each cover panel has the shape of one of the areas of the carcass which is bounded by the channels.

The cover panels may be any conventional cover material for example, leather, synthetic leather, rubber, etc. The outer surface of each cover panel is advantageously provided with the traditional pebbled texture. Each cover panel may be coated with adhesive before being applied to the carcass, and the carcass may also be coated with adhesive.

The cover panels adhere to the spherical surfaces 36 and the curved surfaces 47 and 48 and conform to the contours of those surfaces. Each panel includes an outer edge 50 which abuts the side walls 41 and 42 of the channels which surround the cover panel.

In the particular embodiment illustrated, each cover panel had a uniform thickness of 0.031 inch (0.80 mm) throughout the panel except for the variation in the thickness caused by the pebbled outer surface. The thickness of the cover panel was slightly less than the height of the channels, and the flat outer surfaces 45 and 46 of the channels extended beyond the outer surface of the cover panels.

Cover panels of different thicknesses can also be used. Any thickness which is less than the thickness of conventional panels will achieve cost savings. Thicknesses within the range of about 0.70 to 1.25 mm are preferred, and thicknesses within the range of about 0.70 to 1.00 mm are more preferred. The thickness of the cover panels is preferably uniform or substantially uniform throughout the panel in order to maximize cost savings. However, normal manufacturing tolerances may cause some variation in thickness. As used herein the term "substantially uniform thickness" is meant to include variations due to manufacturing tolerances.

The ball is completed by placing the inflated carcass with the cover panels into a spherical mold which has the shape of the final ball. The ball is heat molded at about 40° C. to bond the cover panels to the carcass.

Because the thin cover panels conform to the shape of the outer surface of the carcass, the outer surface of the completed basketball 20 will have the same shape as the outer surface of the carcass. The completed basketball has a lobular outer surface which is provided by the spherical portion 24 and the recessed portions 25 and 26. The ball therefore has the same look and feel as a traditional ball but costs less to make.

In one specific embodiment of a basketball formed in accordance with the invention, each of the spherical portions 23 of the outer surface had a radius $R_4$ of 4.292 inches from a circle $C_2$ around the center of the ball. The diameter of the circle $C_2$ was 0.732 inch.

While in the foregoing specification a detailed description of specific embodiments of the invention were set forth for the purpose of illustration, it will be understood that many of the details herein given can be varied considerably by those skilled in the art without departing from the spirit and scope of the invention.

We claim:

1. A game ball comprising:

a carcass which includes an inflatable bladder, the carcass having a lobular outer surface which is provided by a plurality of generally spherical portions, channels between adjacent generally spherical portions of the carcass, and recessed portions between channel and the adjacent spherical portions, and a plurality of cover panels secured to the carcass, each cover panel having a central portion which is secured to one of the generally spherical portions of the carcass and a side portion which is secured to one of the recessed surface portions, each of the cover portions having a substantially uniform thickness of less than 1.25 mm, the central portions of the cover panels extending radially outwardly beyond the channels.

2. The game ball of claim 1 in which the thickness of the cover panels is about 0.70 to 1.00 mm.

3. The game ball of claim 1 in which the carcass has a cross sectional thickness through said generally spherical portions which is substantially the same as the cross sectional thickness through the channels.

4. The game ball of claim 1 in which the cross sectional thickness through said generally spherical portions of the carcass is greater than the cross sectional thickness through said channels.

5. The game ball of claim 1 in which each of the channels has a cross sectional height which is substantially the same as the thickness of the cover panels.

6. The game ball of claim 1 in which each of the channels has a cross sectional height which is greater than the thickness of the cover panels.

7. The game ball of claim 1 in which each of said recessed surface portions includes a concave portion which curves laterally outwardly and upwardly from a channel and a convex portion which merges the concave portion with a spherical portion of the carcass.

8. The game ball of claim 1 in which each of the channels includes a pair of flat parallel side walls and an outer surface.

9. The game ball of claim 8 in which the outer surface of each channel is concave and curved.

10. The game ball of claim 1 in which the outer surface of each channel is concave and curved.

11. The game ball of claim 1 in which the thickness of the cover panels is less than 1.00 mm.

* * * * *